US006461201B1

(12) United States Patent
Maeda et al.

(10) Patent No.: US 6,461,201 B1
(45) Date of Patent: Oct. 8, 2002

(54) PRESS-CONTACT JOINT CONNECTOR

(75) Inventors: Akira Maeda; Kei Sato, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/537,750

(22) Filed: Mar. 30, 2000

(30) Foreign Application Priority Data

Mar. 31, 1999 (JP) ..... 11-092687

(51) Int. Cl.[7] ..... H01R 13/502
(52) U.S. Cl. ..... 439/701; 439/680
(58) Field of Search ..... 439/287, 284, 439/289, 285, 701, 680, 695, 717

(56) References Cited

U.S. PATENT DOCUMENTS

| | | | | |
|---|---|---|---|---|
| 3,042,895 A | * | 7/1962 | Bonhomme | 339/176 |
| 3,439,313 A | | 4/1969 | Fischer et al. | |
| 3,771,104 A | * | 11/1973 | Clark | 339/31 R |
| 4,611,879 A | * | 9/1986 | Bullard | 339/198 H |
| 4,931,021 A | * | 6/1990 | Mohan | 439/285 |
| 5,320,555 A | * | 6/1994 | Okabe | 439/354 |
| 5,385,490 A | | 1/1995 | Demeter et al. | 439/579 |
| 5,876,224 A | * | 3/1999 | Chadbourne | 439/110 |
| 5,885,109 A | | 3/1999 | Lee et al. | 439/652 |
| 6,083,029 A | * | 7/2000 | Wu et al. | 439/347 |

FOREIGN PATENT DOCUMENTS

| | | |
|---|---|---|
| DE | 196 50 988 | 6/1998 |
| EP | 0 479 500 A2 | 4/1992 |
| EP | 0 847 108 A1 | 5/1998 |
| EP | 0 845 837 A2 | 6/1998 |

OTHER PUBLICATIONS

Partial European Search Report, Jun. 28, 2001.

* cited by examiner

*Primary Examiner*—Tho D. Ta
*Assistant Examiner*—Phuong Nguyen
(74) *Attorney, Agent, or Firm*—Finnegan, Henderson, Farabow, Garrett, & Dunner, L.L.P.

(57) ABSTRACT

A press-contact joint connector includes: a first and a second connector housings respectively formed with a plurality of terminal housing chambers arranged in parallel; first terminals composed of a plurality of terminals arranged in parallel having tab portions protruded to a side of said connecting surfaces; and second terminals composed of a plurality of terminals arranged having tab contact portions contacting with the tab portions. In the above construction, whole locating means is provided to a connecting surfaces of said first and second connector housings. A pair of tab portion locating means are provided to said connecting surfaces of said first and second connector housings. The tab portion locating means are provided to positions of the vicinities of both outer sides of said tab portions of said plural terminals arranged in parallel.

3 Claims, 14 Drawing Sheets

PRESS-CONTACT JOINT CONNECTOR

BACKGROUND OF THE INVENTION

1. Field of the Invention

The present invention relates to a press-contact joint connector which is constituted so that connector housings are connected in a multiple stage form.

2. Description of the Related Art

A press-contact joint connector in the Related Art includes: an upper connector housing with a plurality of terminal housing chambers; a lower connector housing with a plurality of terminal housing chambers; an upper terminals composed of a plurality of terminals arranged in parallel; and a lower terminals composed of a plurality of terminals arranged in parallel. The upper and the lower connector housings are the same shape so that the upper and the lower connector housings can be connected into a multi-stage form, and can be electrically connected.

However, in the above conventional press-contact joint connector, since the upper and the lower connector housings to be connected are located only by a whole locating protrusions and a whole locating groove portions, there arises the following problem.

Namely, since the dimensions of the whole locating protrusion and the whole locating groove portion are set in contemplation of easiness of engagement, allowance of an error in accuracy of parts and the like, the dimensions have to be different to a certain extent. Therefore, since both the connector housings cannot be located accurately, a suitable contact state between a tab portion formed in the lower terminals and a tab contact portion formed in the upper terminals is not ensured.

In addition, the connecting order of a plurality of the connector housings is determined principally by a wiring pattern or the like, and the connection should be carried out according to the suitable connecting order. However, since the connector housings have the same shape, the connection can be carried out in any order, and thus the connection is possibly carried out in improper order.

SUMMARY OF THE INVENTION

The present invention is devises in such points in view. It therefore is an object of the present invention to provide a press-contact joint connector which ensures a proper contact state between tab portions of terminals of one connector housing and tab contact portions of terminals of the other connector housing. Moreover, an object of the present invention is to provide a press-contact joint connector which is capable of preventing the connection of connector housings in improper order.

According to a first aspect of the invention, there is provided a press-contact joint connector including: a first connector housing having connecting surfaces respectively on its upper surface and lower surface, said first connector housing being formed with a plurality of terminal housing chambers arranged in parallel; a second connector housing having connecting surfaces respectively on its upper surface and lower surface, said second connector housing being connected to said first connector housing in a multi-stage form so that the upper surface of said first connector housing meets the lower surface of said second connector housing, the upper surface of said first connector housing facing the lower surface of said second connector housing, said second connector housing being formed with a plurality of terminal housing chambers arranged in parallel; first terminals composed of a plurality of terminals arranged in parallel, said first terminals being housed respectively in said terminal housing chambers formed on said first connector housing, said first terminals having tab portions protruded to a side of said connecting surfaces, said first terminals having tab contact portions on a side opposite to the side of said connecting surfaces; and second terminals composed of a plurality of terminals arranged in parallel, said second terminals being housed respectively in said terminal housing chambers formed on said second connector housing, said second terminals having tab contact portions contacting with the tab portions of said first terminals on the side of said connecting surfaces, said second terminals having tab portions on a side opposite to the side of said connecting surfaces, wherein whole locating means, for locating wholly said first and second connector housings when said connecting surfaces of said first and second connector housings which face each other are moved to a connecting position where they come close to and are connected to each other, is provided to said connecting surfaces of said first and second connector housings; a pair of tab portion locating means, for locating said both connector housings in a tab parallel arranging direction where the tab portions of said first terminals are arranged in parallel and in a direction which intersects perpendicularly to the tab parallel arranging direction, are provided to said connecting surfaces of said first and second connector housings; and said tab portion locating means are provided to positions of the vicinities of both outer sides of said tab portions of said plural terminals arranged in parallel.

In the press-contact joint connector according to the first aspect, the pair of tab portion locating means locate the tab parallel arranging direction and the direction intersecting perpendicularly to the tab parallel arranging direction between both the connector housings. Therefore, a proper contact state between the tab portions of the terminals of the first connector housing and the tab contact portions of the terminals of the second connector housing is ensured.

A second aspect of the invention provides a press-contact joint connector including: a first connector housing having connecting surfaces respectively on its upper surface and lower surface, a second connector housing having connecting surfaces respectively on its upper surface and lower surface, said second connector housing being connected to said first connector housing in a multi-stage form so that the upper surface of said first connector housing meets the lower surface of said second connector housing, the upper surface of said first connector housing facing the lower surface of said second connector housing, wherein said connecting surfaces of said first and second connector housings which face each other are moved to a connecting position where they come close to and are connected to each other so that said first and second connector housings are connected; a plurality of mis-connection preventing protrusions which can be cut are provided to one side of said connecting surfaces of said first and second connector housings which face each other; a plurality of hole portions into which said mis-connection preventing protrusions can be inserted are provided to the other side of the connecting surfaces of said first and second connector housings which face each other; said plurality of hole portions are provided to positions corresponding to said plurality of mis-connection preventing protrusions; and walls which can be cut are provided respectively to said plurality of hole portions.

In the press-contact joint connector according to the second aspect, the mis-connection preventing protrusions and the walls of the hole portions are cut previously so that only the mis-connection preventing protrusions and the hole portions on the surfaces to be connected are combined according to a proper order of connecting the connector housings. As a result, even if they are tried to be connected in an improper order, the connection cannot be carried out. Therefore, the connection of the connector housings in an improper order can be prevented.

A third aspect of the present invention provides the press-contact joint connector depending from the first aspect, wherein: a plurality of mis-connection preventing protrusions which can be cut are provided to one side of the connecting surfaces of said first and second connector housings which face each other; a plurality of hole portions, into which said mis-connection preventing protrusions are inserted respectively, are provided to the other side of the connecting surfaces of said first and second connector housings which face each other; said plurality of hole portions are provided to positions correspondingly to said plurality of mis-connection preventing protrusions; and walls which can be cut are formed respectively to said plurality of hole portions.

In the press-contact joint connector according to the third aspect, in addition to the working of the first aspect, the mis-connection preventing protrusions and the walls of the hole portions are cut previously so that only the mis-connection preventing protrusions and the hole portions of the surfaces to be connected are combined in a proper order of connecting the connector housings. As a result, even if they are tried to be connected in an improper order, the connection cannot be carried out.

A fourth aspect of the invention provides the press-contact joint connector depending from the first or third aspect, wherein: said pair of tab portion locating means are composed of a pair of protruded portions which are provided to one side of the connecting surfaces of said first and second connector housings and a pair of groove portions which are provided to the other side of connecting surfaces; said pair of protruded portions are engaged with said pair of groove portions; said pair of protruded portions and said pair of groove portions become wider towards a direction where they come close to or are separated from each other in the tab parallel arranging direction; and a distance between said pair of protruded portions and a distance between said pair of groove portions are set so as to be slightly different.

In the press-contact joint connector according to the fourth aspect, in addition to the working of the first or third aspect, an external force is applied to the connector housings to a direction of drawing or compressing with respect to the tab parallel arranging direction via the pair of tab portion locating means, and an external force is applied to the connector housings to a direction which intersects perpendicularly to the tab parallel arranging direction via the tab portion locating means. Therefore, an unstable state of both the connector housings can be prevented.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
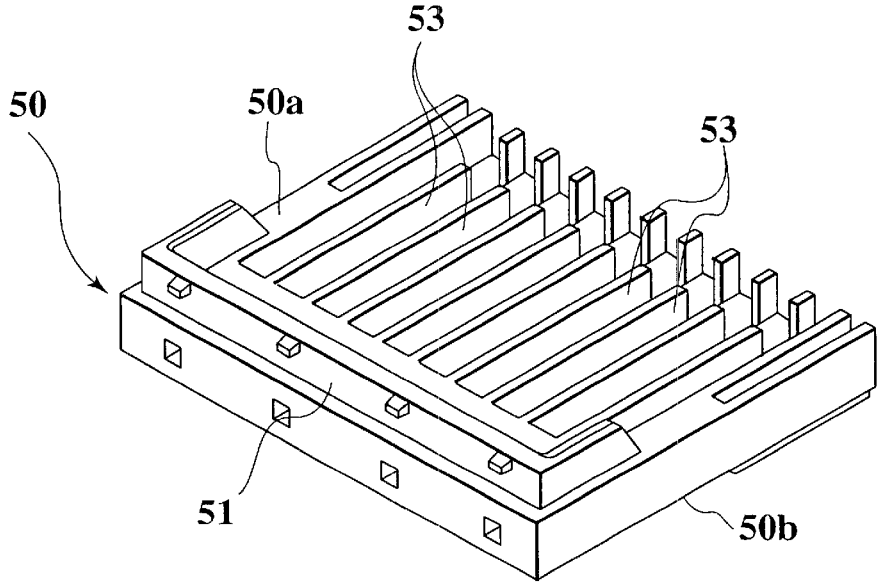
FIG. 1 is a perspective view of a connector housing in a first embodiment of the present invention before a terminal assembly is attached.
Figure 2:
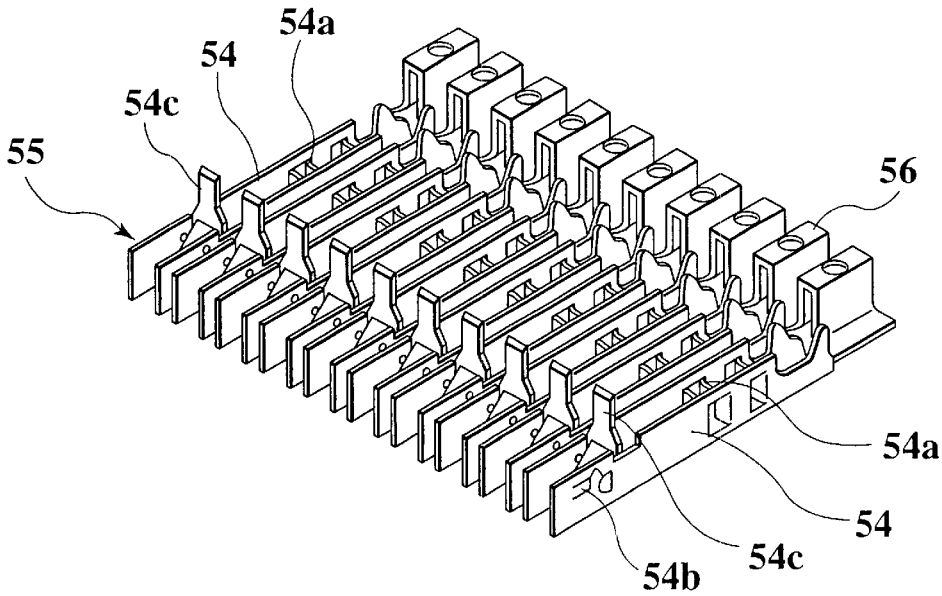
FIG. 2 is a perspective view of a terminal assembly.

There will be detailed below the preferred embodiments of the present invention with reference to the accompanying drawings. Like members are designated by like reference characters.

Referring now to FIG. 1 to FIG. 5, a press-contact joint connector according to a first embodiment of the present invention will be described hereinbelow.

FIG. 1 is a perspective view of a connector housing 50 before a terminal assembly 55 or the like is attached, FIG.

Figure 3:
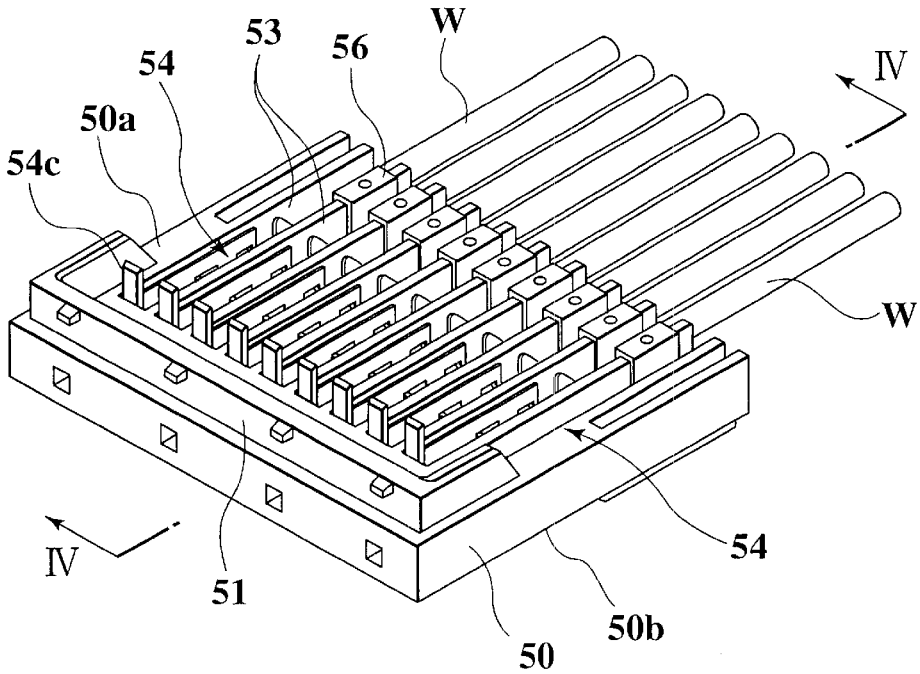
FIG. 3 is a perspective view of the connector housing in a state that the terminal assembly is attached.
Figure 4:
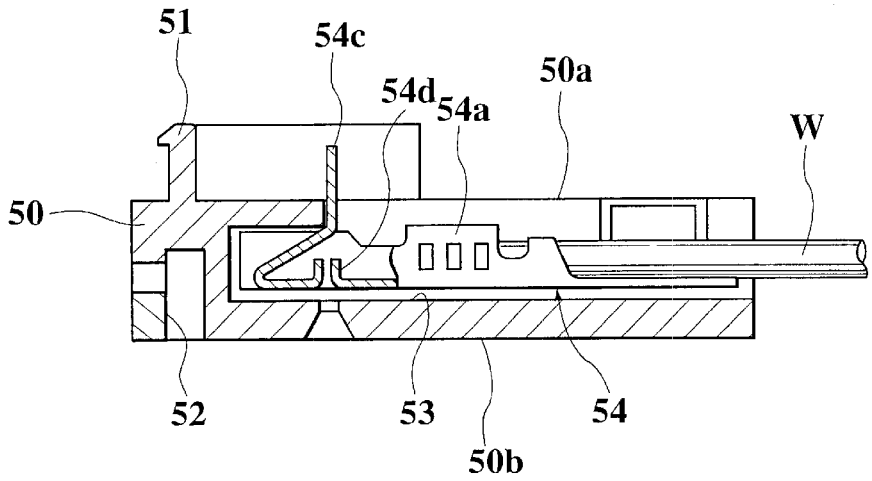
FIG. 4 is a cross section taken along the line IV—IV of FIG. 3.
Figure 5:
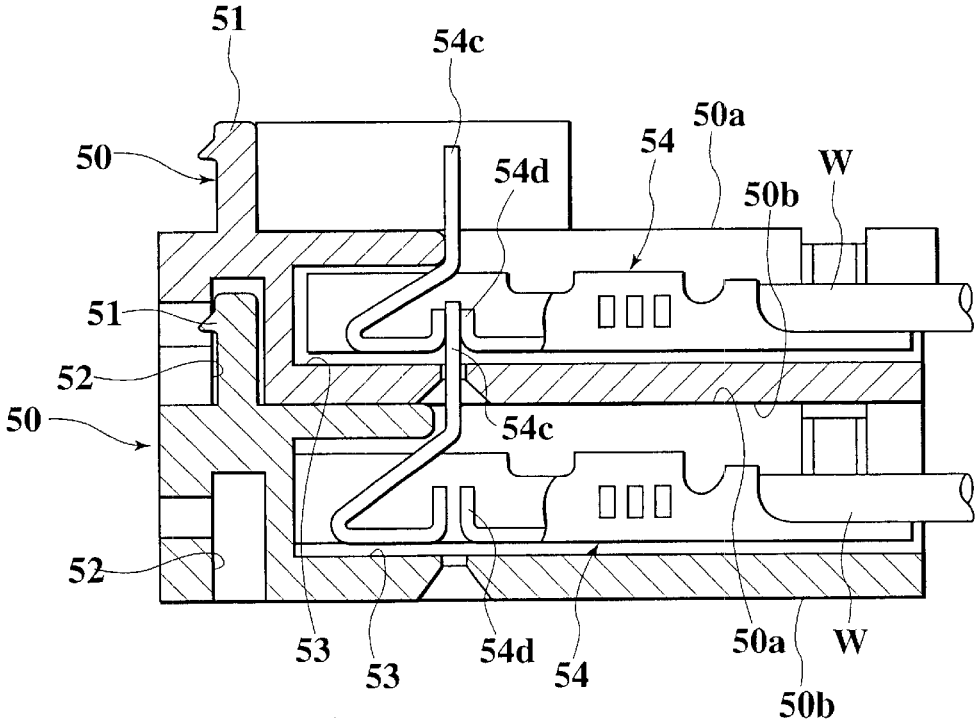
FIG. 5 is a cross section showing a connecting state of the connector housings.

2 is a perspective view of the terminal assembly 55, FIG. 3 is a perspective view of the connector housing 50 in the state that the terminal assembly 55 or the like is attached, FIG. 4 is a cross section taken along the line IV—IV of FIG. 3, and FIG. 5 is a cross section showing the connected state of the connector housings 50.

In FIGS. 1 through 4, as for the connector housing 50, its upper surface and lower surface are composed as connecting surfaces 50*a* and 50*b* respectively, and a whole locating protrusion 51 is provided to forward portions on both sides of the upper connecting surface 50*a* and to a whole front surface portion, and a whole locating groove portion 52 (shown in FIG. 4) is provided to corresponding portions of the lower connecting surface 50*b*. At the time of connection, the whole locating protrusions 51 and the whole locating groove portions 52 compose whole locating means.

A plurality of terminal housing chambers 53 are provided to the connector housing 50, and terminals 54 are housed respectively in the terminal housing chambers 53. The plurality of terminals 54 are composed as a terminal assembly 55 shown in FIG. 2 in a stage before they are attached to the connector housing 50, and the terminal assembly 55 is composed of the plurality of terminals 54 arranged in parallel and carrier portions 56 which connect the terminals 54. After the terminal assembly 55 is attached to the housing 50, the carrier portions 56 between the terminals 54 not requiring electrical connection are cut. The terminals 54 have electric wire press-contact portions 54*a* to which electric wires W press-contact respectively, housing engagement portions 54*b* which are engaged with the connector housing 50, tab portions 54*c* which are protruded to a side of the upper connecting surface 50*a,* and tab contact portions 54*d* which contact with the tab portions 54 which are inserted from the lower connecting surface 50*b*.

There will be described below the connection of the connector housings 50. The connecting surfaces 50*a* and the connecting surfaces 50*b* of both the connector housings 50 are moved to a direction where they come close to each other, and the whole locating protrusions 51 and the whole locating groove portions 52 are located so as to meet each other. When they are located, the connecting surfaces 50*a* and the connecting surfaces 50*b* of both the connector housings 50 are further moved to the direction where they come close to each other, and when the connecting surfaces 50*a* and the connecting surfaces 50*b* are connected to each other, the housings are locked so that the connection is completed as shown in FIG. 5.

In addition, in accordance with the movement of both the connector housings 50 to the connecting position, the tab portions 54*c* of the terminals 54 of the lower connector housing 50 enter the upper connector housing, and as shown in FIG. 5, the tab portions 54*c* of the terminals 54 of the lower connector housing 50 are brought into contact with the tab contact portions 54*d* of the terminals 54 of the upper connector housing 50 in the connecting position. Here, in the case where the upper and lower terminals 54 do not electrically contact with each other, the tab portions 54*c* are previously bent.

In such a manner, the connector housings 50 with the same shape can be connected into a multi-stage form, and the terminals 54 of the adjacent upper and lower connector housings 50 can be electrically connected.

However, in the above press-contact joint connector, since the connector housings 50 to be connected are located only by the whole locating protrusions 51 and the whole locating groove portions 52, there arises the following problem.

Namely, since the dimensions of the whole locating protrusion 51 and the whole locating groove portion 52 are set in contemplation of easiness of engagement, allowance of an error in accuracy of parts and the like, the dimensions have to be different to a certain extent. Therefore, since both the connector housings 50 cannot be located accurately, a suitable contact state between the tab portions 54*c* of the lower terminals 54 and the tab contact portions 54*d* of the upper terminals 54 is not ensured.

In addition, the connecting order of a plurality of the connector housings 50 is determined principally by a wiring pattern or the like, and the connection should be carried out according to the suitable connecting order. However, since the connector housings 50 have the same shape, the connection can be carried out in any order, and thus the connection is possibly carried out in improper order.

In this connection, the applicants have improved the press-contact joint connector as described in a second and third embodiments hereinbelow.

In FIGS. 6A through 12B, as for a connector housing 1, its upper surface and lower surface are composed as connecting surfaces 1*a* and 1*b* respectively, and a whole locating protrusion 2 is provided to forward portions on both sides of the upper connecting surface 1*a* and to a substantially whole front surface portion, and a whole locating groove portion 3 is provided to corresponding portions of the lower connecting surface 1*b*. At the time of connection, the whole locating protrusions 2 and the whole locating groove portions 3 of both the connector housings 1 compose whole locating means 4. Relative dimensions of the whole locating protrusion 2 and whole locating groove portion 3 are set with allowance so that the whole locating protrusions 2 can be inserted into the whole locating groove portions 3 easily and an error in accuracy of parts can be allowed. The whole locating protrusions 2 which face each other have respectively counter surfaces 2*a* which face each other.

Figure 12A:
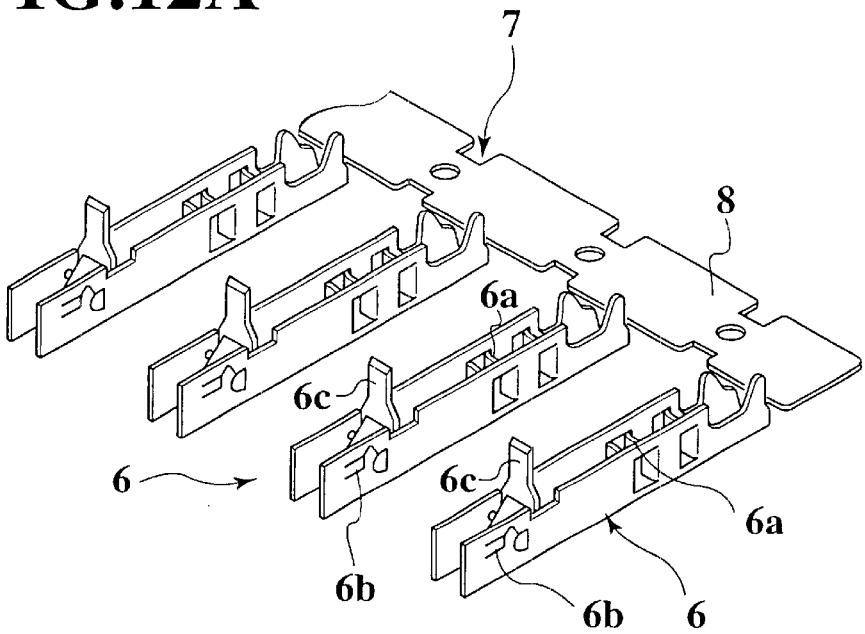
FIG. 12A is a diagram showing a prestage of the terminal assembly according to the second embodiment of the present invention.
Figure 12B:
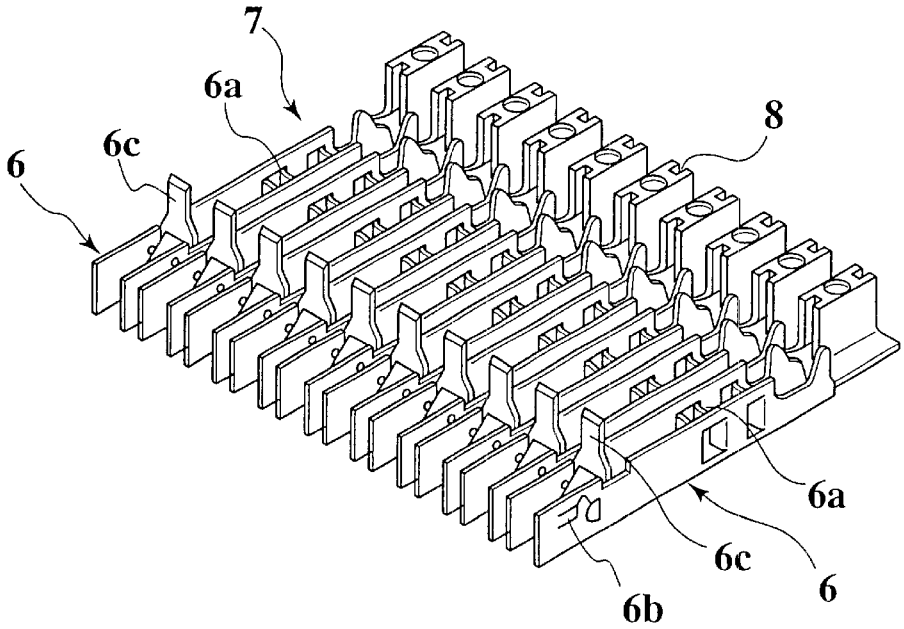
FIG. 12B is a perspective view of the terminal assembly.

The connector housing 1 is provided with a plurality of terminal housing chambers 5, and terminals 6 are housed respectively in the terminal housing chambers 5. The plurality of terminals 6 are composed as a terminal assembly 7 shown in FIG. 12B in a stage before the terminals 6 are attached to the connector housing 1. The terminal assembly 7 is composed of the plurality of terminals 6 arranged in parallel and carrier portions 8 which connect the plurality of terminals 6. The terminal assembly 7 is constituted in such a manner that plate-shaped electroconductive metal is blanked into a predetermined shape and it is bent and a plurality of terminals 6 are formed as shown in FIG. 12A, and the carrier portion 8 which connects the plural terminals 6 are bent into a continuous wave shape.

The terminals 6 have respectively electric wire press-contact portions 6*a* with which electric wires W press-contact, housing engagement portions 6*b* which are engaged with the connector housing 1, tab portions 6*c* which are protruded to a side of the upper connecting surface 1*a,* and tab contact portions 6*d* which contact with the tab portions 6*c* which are inserted from the lower connecting surface 1*b*. Tab insertion holes 1*c* are provided respectively to portions of the connector housing 1 where the tab contact portions 6*d* are positioned in a state that the terminals 6 are attached to the connector housing 1.

In addition, a pair of tab portion locating means 9 are composed of a pair of protruded portions 10 which are provided in positions in both outer vicinities of the tab portion 6*c* of the plural terminals 6 arranged in parallel on the upper connecting surface 1*a* of the connector housing 1, and a pair of groove portions 11 which are provided in positions in both the outer vicinities of the tab portion 6*c* of the plural terminals 6 arranged in parallel on the lower connecting surface 1*b* of the connector housing 1 and are engaged with the protruded portions 10 respectively. In the case where both the connectors 1 are connected, a pair of the protruded portions 10 of the lower connector housing 1 are engaged with a pair of the groove portions 11 of the upper connector housing 1 so that a tab parallel arranging direction T where the tab portions 6*c* of the terminals 6 are arranged in parallel and a direction S which intersects perpendicularly to the tab parallel arranging direction are located.

In the second embodiment, an inclined surface 10S is formed on a pair of the protruded portions 10 which face each other so as to be wider towards a direction where they come close to the tab parallel arranging direction T, and an inclined surface 11S is formed to a pair of the groove portions 11 so as to be wider towards the direction where they come close to the tab parallel arranging direction T. Moreover, when a distance between a pair of the protruded portions 10 is determined as L1 (shown in FIG. 7) and a distance between a pair of the groove portions 11 is determined as L2 (shown in FIG. 9), the distances are set with a slight dimensional difference so that L1>L2.

Front side housing lock means 12 is composed of a plurality of lock protruded portions 13 which are provided to the front surface of the whole locating protrusion 2 and lock groove portions 14 which are provided to corresponding lower positions. Rear side housing lock means 15 is composed of lock claw portions 16 which are protruded downward from the lower connecting surface 1 on the rear side of the connector housing 1, and lock groove portions 17 which are formed on the upper connecting surface 1*a* on the rear side of the connector housing 1.

Figure 13:
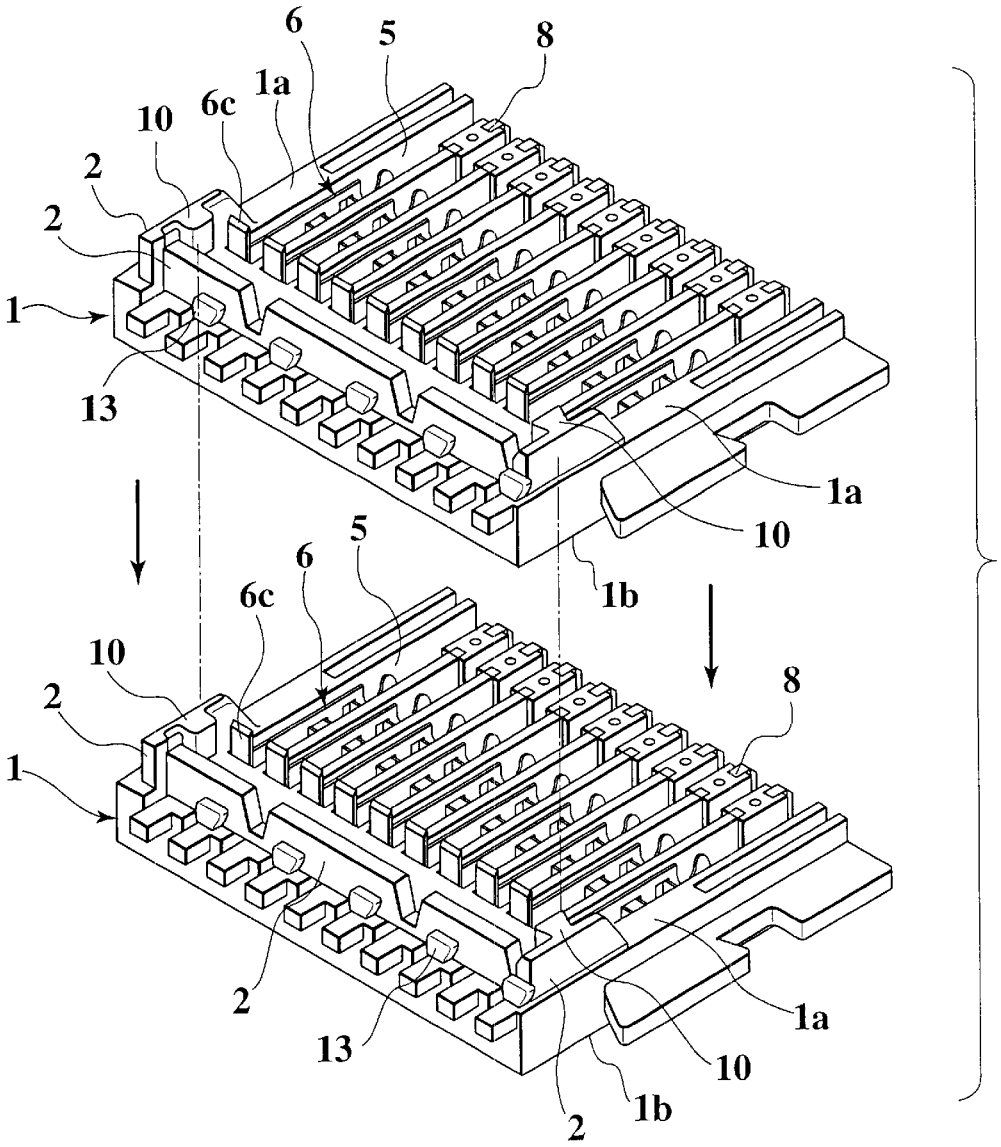
FIG. 13 is a perspective view of the connector housing for explaining the connecting step of the connector housings.

There will be described below the connection of the connector housings 1. In FIG. 13, the connecting surfaces 1*a* and the connecting surfaces 1*b* of both the connector housings 1 are moved to a direction where they come close to each other, and the whole locating protrusions 2 and the whole locating groove portions 3 are located so as to meet. As a result, the connecting surfaces 1*a* and the connecting surfaces 1*b* of both the connector housings 1 are further moved to the direction where they come close to each other, and when the connecting surfaces 1*a* and the connecting surfaces 1*b* are connected, the front side housing lock means 12 and the rear side housing lock means 15 composed of both the connector housings 1 lock the connector housings 1 so that the connection is completed as shown in FIG. 14.

Figure 14:
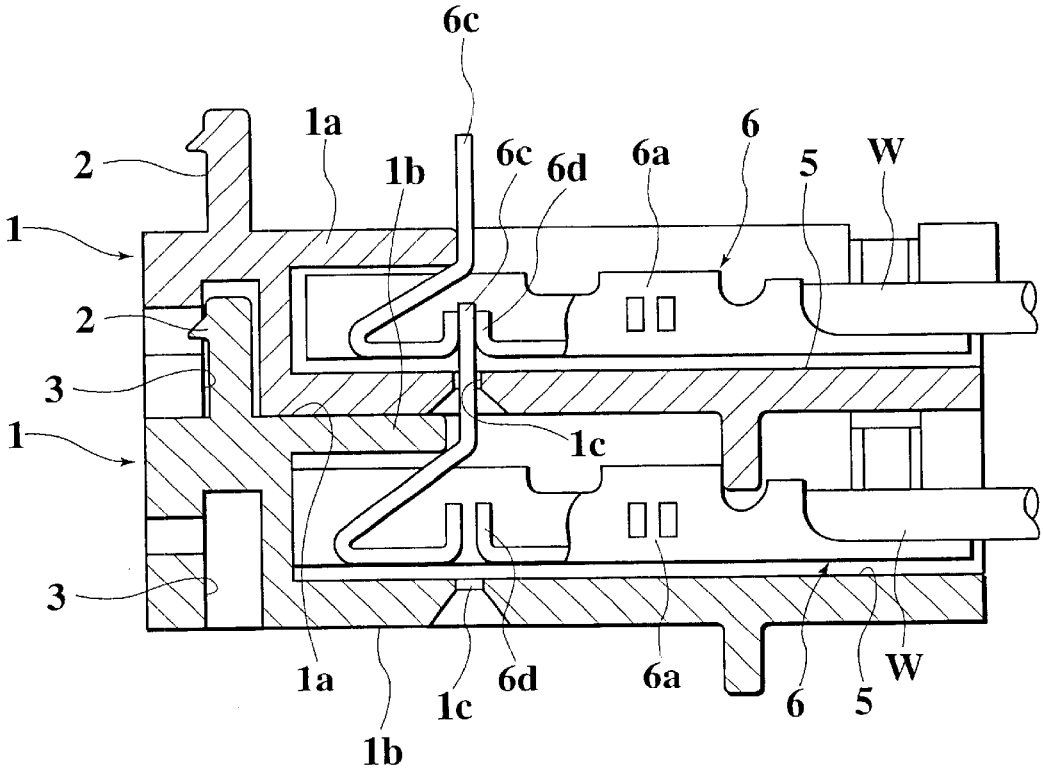
FIG. 14 is a cross section showing the connecting state of the connector housings.

In addition, according to the movement of both the connector housings 1 to the connecting position, the tab portions 6*c* of the terminals 6 of the lower connector housing 1 enter the tab insertion holes 1*c* of the upper connector housing 1, and the tab portions 6*c* of the terminals 6 of the lower connector housing 1 come in contact with the tab contact portions 6*d* of the terminals 6 of the upper connector housing 1 in the connecting position as shown in FIG. 14. In the case where the upper and lower terminals 6 are not brought into contact electrically, the tab portions 6*c* are previously bent, and the section of the carrier portions 8, which are positioned between the terminals 6 which do not have to be electrically connected, are cut in the process of attaching them to the connector housing 1.

In the connector housings 1 which are connected in such a manner, the pair of tab portion locating means 9 locate the tab parallel arranging direction T and the direction S intersecting perpendicularly to the direction T between both the connector housings 1, thereby ensuring the suitable contact state between the tab portions 6*c* of the terminals 6 of the one connector housing 1 and the tab contact portions 6*d* of the terminals 6 of the other connector housing 1.

In addition, in the second embodiment, since the pair of protruded portions 10 and the pair of groove portions 11 become wider towards the direction where they come close to each other in the tab parallel arranging direction T and the distance between the pair of protruded portions 10 and the distance between the pair of groove portions 11 are set slightly differently, the surfaces of the protruded portions 10 contact with the surfaces of the groove portions 11 at one point.

Figure 6A:
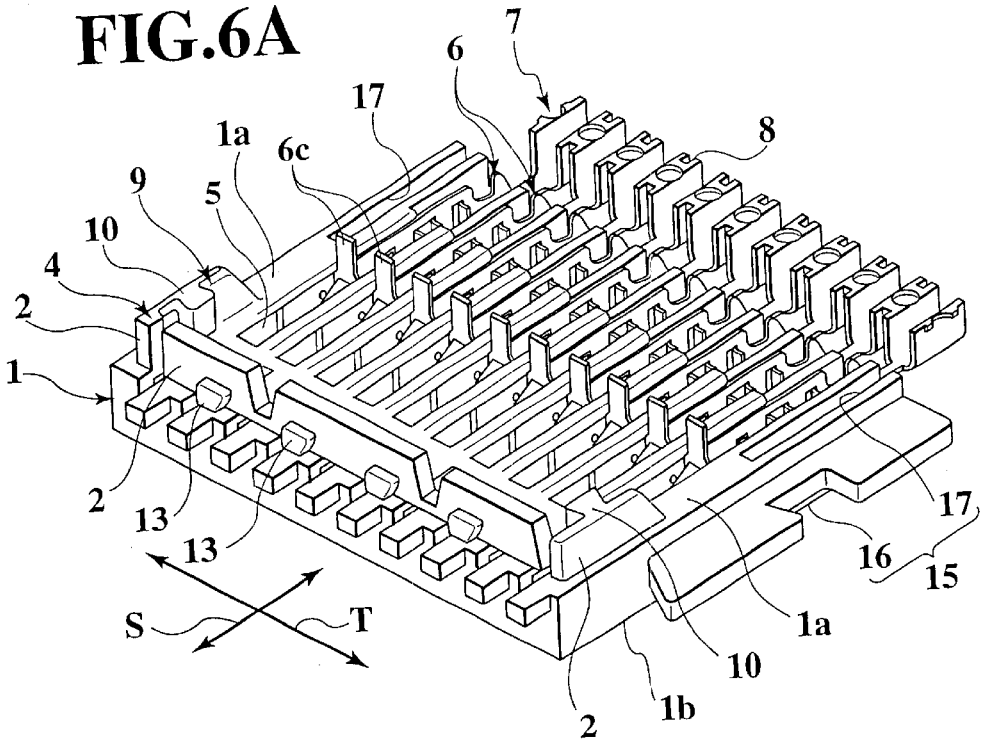
FIG. 6A is a perspective view of a connector housing in a state that a terminal assembly is inserted to a temporary attaching position in a second embodiment of the present invention.
Figure 6B:
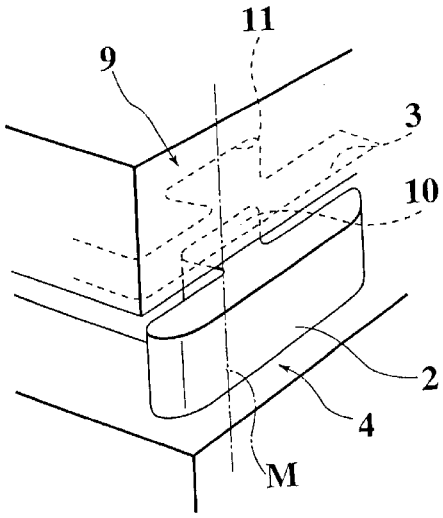
FIG. 6B is a perspective view showing tab portion locating means.
Figure 6C:
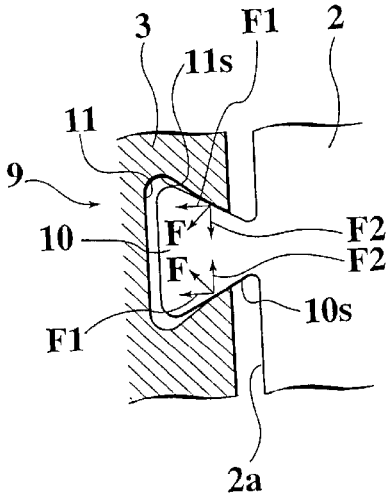
FIG. 6C is a cross section showing the tab portion locating means.
Figure 7:
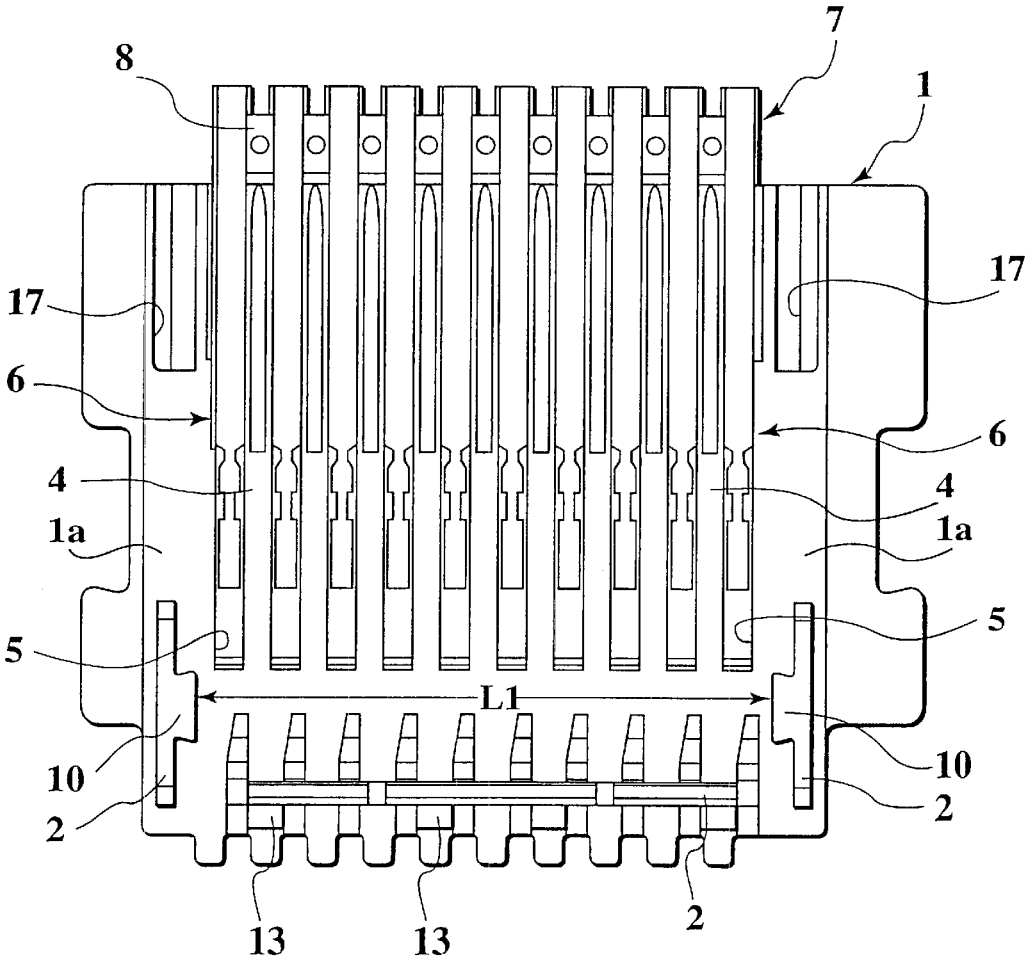
FIG. 7 is a plan view of the connector housing in a state that the terminal assembly is inserted to the temporary attaching position in the present invention.
Figure 8:
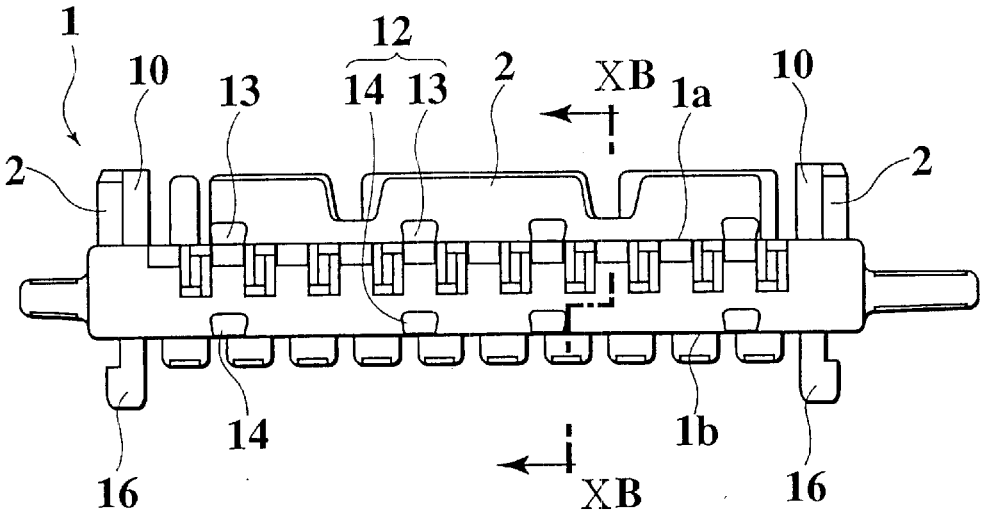
FIG. 8 is a front view of the connector housing of the present invention.
Figure 9:
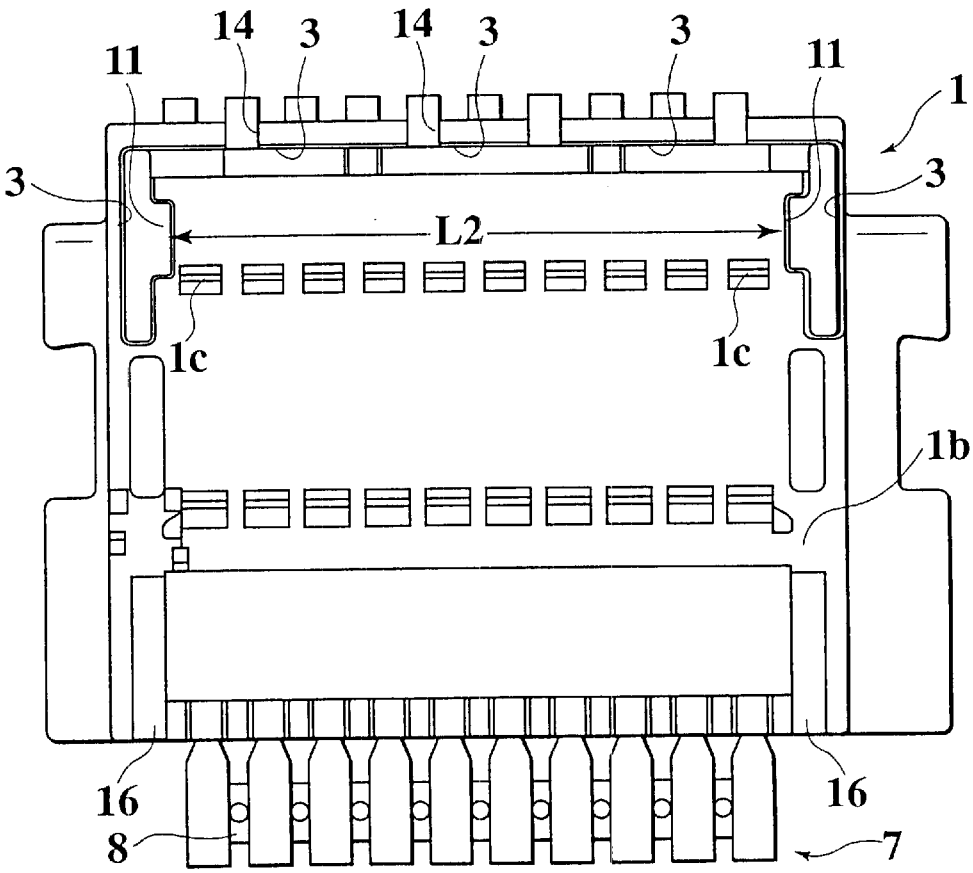
FIG. 9 is a bottom view of the connector housing of the present invention.
Figure 10A:
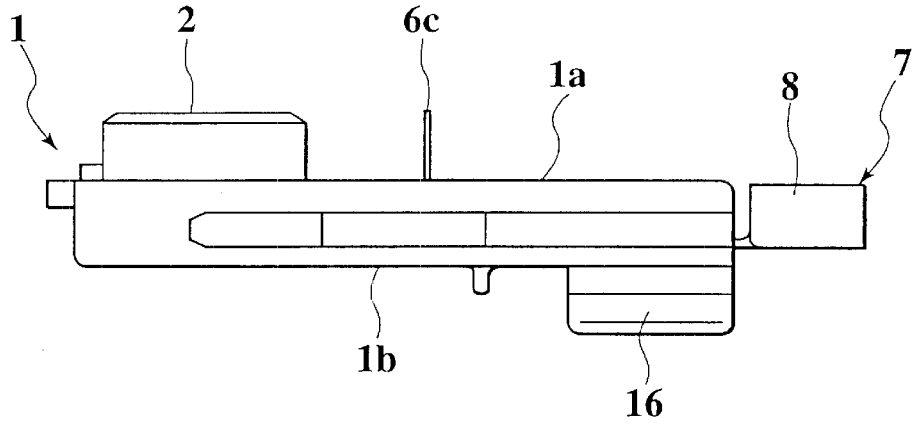
FIG. 10A is a side view of the connector housing according to the second embodiment of the present invention.
Figure 10B:
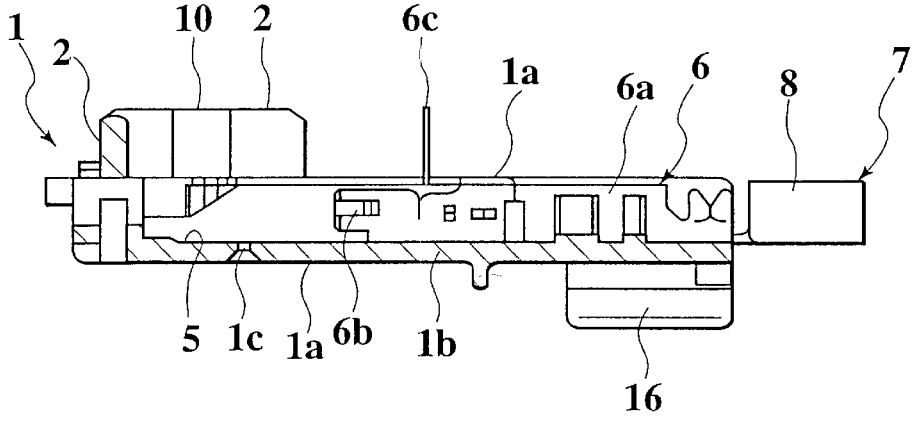
FIG. 10B is a cross section taken along the line XB—XB of FIG. 8.
Figure 11:
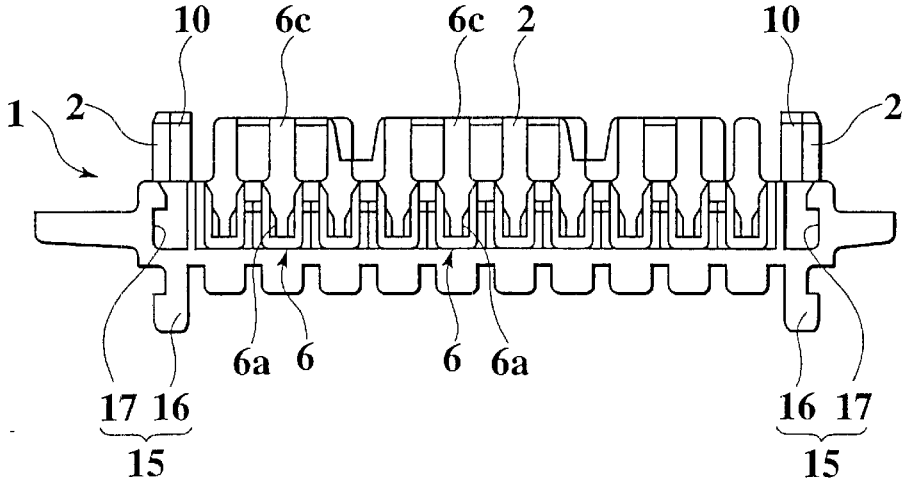
FIG. 11 is a rear view of the connector housing of the present invention.

Therefore, as shown in FIG. 6C, since an external force F is applied to the upper connector housing 1, due to a component of force F1 of the tab parallel arranging direction T in the external force F of the pair of tab portion locating means 9, an external force (reactive force described above) is applied to the upper connector housing 1 to a direction of drawing to the tab parallel arranging direction T, and an external force is applied to the lower connector housing 1 to a direction of compressing to the tab parallel arranging direction T. As a result, an unstable state of both the connector housing 1 can be prevented.

In addition, the upper connector housing 1 is located in the direction S which intersects perpendicularly to the tab parallel arranging direction T by a component of force F2 of the direction S intersecting perpendicularly to the tab parallel arranging direction T of the outer force F, and the unstable state is prevented. The lower connector housing 1 is located in the direction S which intersects perpendicularly to the tab parallel arranging direction T similarly as a reactive force is applied to the lower connector housing 1, and the unstable state is prevented. Namely, the pair of tab portion locating means 9 are located with respect to a locating line M shown in FIG. 6B at least.

Figure 15A:
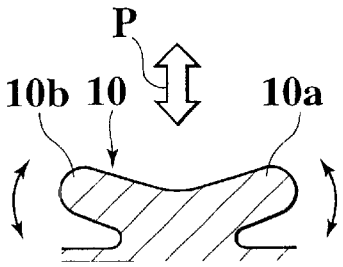
FIG. 15A, FIG. 15B and FIG. 15C are diagrams showing various structures of protruded portions of tab portion locating protrusions.
Figure 15B:
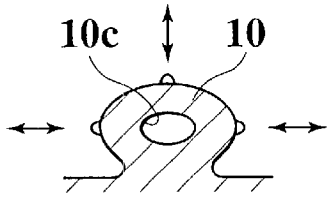
Figure 15C:
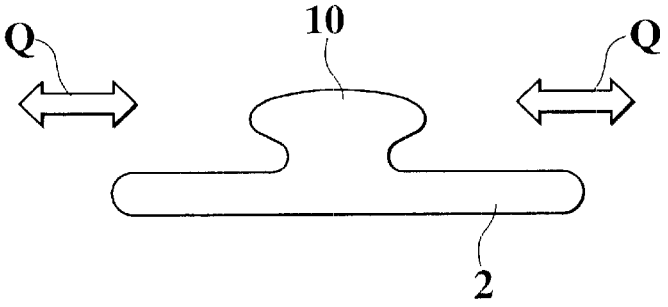
Figure 16:
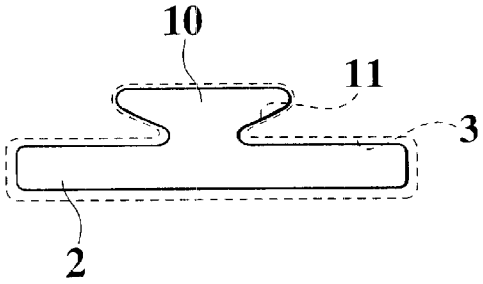
FIG. 16 is a diagram showing a dimensional relationship or the like between a whole locating protrusion and a whole locating groove portion.

Next, there will be detailed below an unstable state absorbing form of the protruded portions 10 of the tab portion locating means 9 with reference to FIGS. 15A, 15B and 15C. As shown in FIG. 15A, as the shape of the protruded portions 10, when the protruded portion 10 is divided into a right side portion 10*a* and a left side portion 10*b*, they are extended to a diagonal direction, and their center portions are hollowed. However, in this shape, since it is necessary to move a die to a direction of the arrow P, this is different from the moving direction of a die for forming the connector housing 1 in the first embodiment, and this shape is disadvantageous in cost. Moreover, as shown in FIG. 15B, it is considered that the protruded portion 10 has a cylindrical shape having a hole 10*c* inside, but in this shape it is necessary to move the die to a direction intersecting perpendicularly to the paper surface. Therefore, the direction is different from the moving direction of the die for forming the connector housing 1 in the first embodiment, and this shape is disadvantageous in cost. A shape of the first embodiment shown in FIG. 15C is advantageous in cost because the moving direction is the same as the moving direction Q of the die for forming the first connector 1 in the first embodiment.

There will be described below a dimensional relationship between the whole locating protrusions 2 and the protruded portions 10 and between the whole locating groove portions 3 and the groove portions 11. As mentioned above, since the protruded portions 10 and groove portions 11 of the tab portion locating means 9 can prevent the unstable state between the connector housings 1, even if a difference in dimension between the whole locating protrusions 2 and the whole locating groove portions 3 are set larger to a certain extent, there is no fear that unstableness occurs. Therefore, the dimensions of the whole locating protrusion 2 and the whole locating groove portion 3 can be set so that the whole locating protrusions 2 are easily inserted into the locating groove portions 3.

Figure 17:
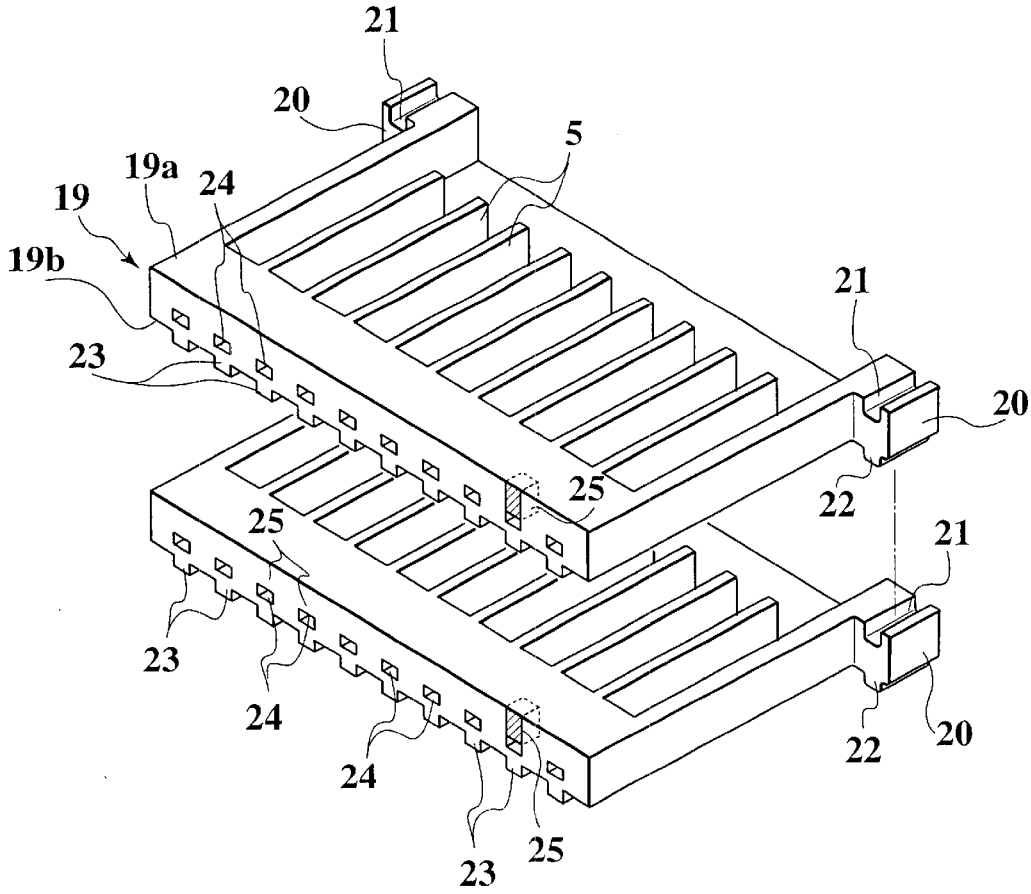
FIG. 17 shows a third embodiment of the present invention, and in particular it is a perspective view of two connector housings to be connected.
Figure 18:
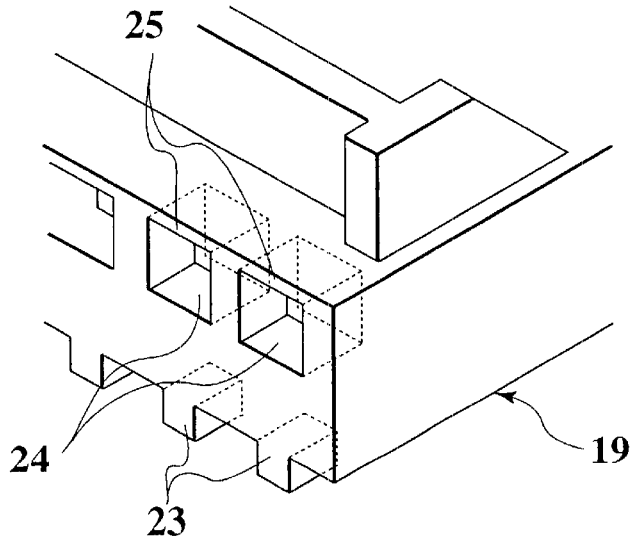
FIG. 18 is a perspective view in a vicinity of mis-connection preventing protrusions and hole portions of the connector housing according to the third embodiment of the present invention.
Figure 19:
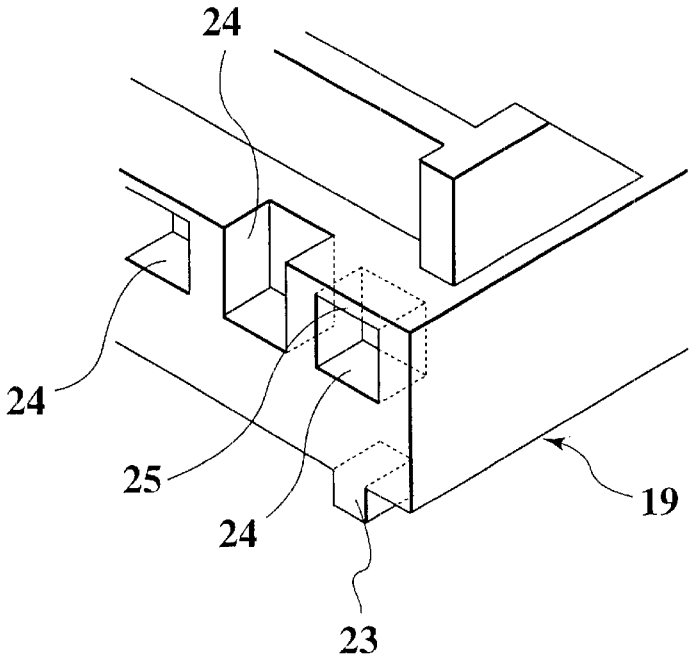
FIG. 19 is a perspective view showing a main portion of the connector housing in a state that an excessive mis-connection preventing protrusion and an excessive wall portion are cut.
Figure 20:
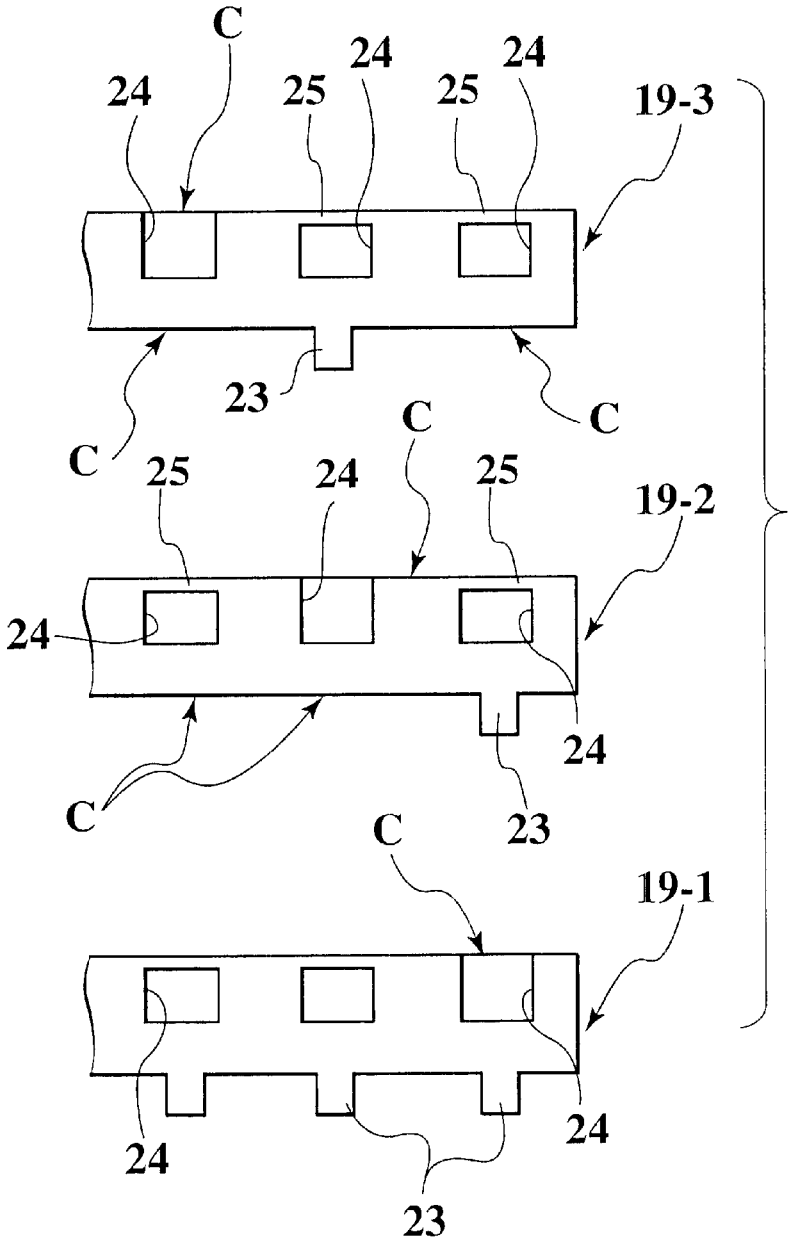
FIG. 20 is a front view showing a state that a plurality of connector housings are connected.

FIGS. 17 through 20 show a third embodiment of the present invention, FIG. 17 is a perspective view of the two connector housings to be connected, FIG. 18 is a perspective view of vicinities of a mis-connection preventing protrusion and a hole of the connector housing, FIG. 19 is a perspective view showing the main portion of the connector housing in a state that an excessive mis-connection preventing portion and an excessive wall portion are cut, and FIG. 20 is a front view showing a state that a plurality of connector housings are connected.

In FIG. 17, in a connector housing 19, its upper surface and its lower surface are composed respectively as connecting surfaces 19*a* and 19*b*, and a locating protruded portion 20 is protruded from both outer sides of the rear side. A concave portion 21 is provided to upper surfaces of the locating protruded portions 20, and a convex portion 22 is provided to lower surfaces. The concave portion 21 becomes wider towards a bottom surface, and the convex portion 22 becomes wider towards a top surface. The convex portions 22 of the upper connector housing 19 are fitted into the concave portions 21 of the lower connector housing 19 in the connecting position of both the connector housings 19 to be connected so that both the connector housings 19 are locked.

A plurality of terminal housing chambers 5 are provided to the connector housing 19, and terminals (not shown) are housed respectively in the terminal housing chambers 5.

A plurality of mis-connection preventing protrusions 23 are provided to the lower connecting surface 19*a* on the front side of the connector housing 19, and the mis-connection preventing protrusions 23 can be easily cut. FIG. 19 shows the state that the mis-connection preventing protrusions 23 are cut but one is left. A plurality of hole portions 24 are provided to positions in the vicinity of the upper connecting surface 19*a* on the front side of the connector housing 19 correspondingly to the plurality of mis-connection preventing protrusions 23. Thin walls 25 are removably provided above the hole portions 24 (partially represented by hatching). FIG. 19 shows the state that one wall 25 of the hole portion 24 is removed. The wall 25 is removed so that the mis-connection protecting protrusion 23 can be inserted into the hole portion 24. Namely, the mis-connection preventing protrusions 24 and the hole portions 24 having the walls 25 compose mis-connection preventing means.

Next, there will be described below the connecting work of the connector housings 19. Prior to the actual connecting work of the connector housings 19, the mis-connection preventing protrusions 23 and the walls 25 of the hole portions 24 are cut previously so that only the mis-connection preventing protrusions 23 and the hole portion 24 of the connecting surfaces 1*a* and the connecting surfaces 1*b* are combined according to a suitable connecting order of the connector housings 19.

For example, as shown in FIG. 20, as for the connector housing 19-1 in the first stage, the wall 25 of the first hole portion 24 from the right is removed. As for the connector housing 19-2 in the second stage, all other than the first mis-connection preventing protrusion 23 from the right are cut, and the wall 25 of the second hole portion 24 from the right is removed (see FIG. 19). As for the connector housing 19-3 in the third stage, all other than the second mis-connection preventing protrusion 23 from the right are cut, and the wall 25 of the third hole portion 24 from the right is removed. According to this rule, the connector housings 19 in the fourth and thereafter stages are processed. The positions where the walls 25 are removed and the positions where the mis-connection preventing protrusions 23 are cut are presented by C.

After this process, the connector housings 19 are connected actually. Here, if the housings are tried to be mis-connected, the mis-connection preventing protrusions 23 are obstructed by the walls 25 so as not to be engaged with the hole portion 24. As a result, the connection of the connector housings 19 in an improper connecting order can be avoided.

Incidentally, when the mis-connection preventing means of the connector housing 19 in the third embodiment is added to the connector housing 1 of the second embodiment, in addition to the working and effect of the first embodiment, the connection of the connector housings 1 in an improper order can be prevented. Moreover, when the tab portion locating means 9 of the connector housing 1 in the first embodiment is added to the connector housing 19 of the second embodiment, in addition to the working and effect of the second embodiment, the proper contact state between the tab portions of the terminals of the one connector housing 19 and the tab contact portions of the terminals of the other connector housing 19 is ensured. Further, since the front surface of the connector housing 19 is a mounting side of the mated connector, if the front surfaces of both the connector housings 19 are displaced from each other, the mounting of the mated connector is possibly interfered, but this does not occur in this embodiments.

In the second embodiment, the pair of protruded portions 10 may become wider towards a direction where they are separated from each other with respect to the tab parallel arranging direction T, and the pair of groove portions 11 may become wider towards a direction where they are separated from each other with respect to the tab parallel arranging direction T. In this case, when the distance between the pair of protruded portions 10 is determined as Ll and the distance between the pair of groove portions 11 is determined as L2, the distances are set with a slight difference so that L1<L2.

The entire contents of Japanese Patent Application P11-92687 (filed Mar. 31, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A press-contact joint connector, comprising:

a first connector housing having connecting surfaces respectively on its upper surface and lower surface, said first connector housing being formed with a plurality of terminal housing chambers arranged in parallel;

a second connector housing having connecting surfaces respectively on its upper surface and lower surface, said second connector housing being connected to said first connector housing in a multi-stage form so that the upper surface of said first connector housing meets the lower surface of said second connector housing, the upper surface of said first connector housing facing the lower surface of said second connector housing, said second connector housing being formed with a plurality of terminal housing chambers arranged in parallel;

first terminals composed of a plurality of terminals arranged in parallel, said first terminals being housed respectively in said terminal housing chambers formed on said first connector housing, said first terminals having tab portions protruding through one of said connecting surfaces, said first terminals having tab contact portions on a connecting surface opposite to the side of said connecting surface having the protruding tab portions; and second terminals composed of a plurality of terminals arranged in parallel, said second terminals being housed respectively in said terminal housing chambers formed on said second connector housing, said second terminals having tab contact portions contacting with the tab portions of said first terminals on one of said connecting surfaces, said second terminals having tab portions on an opposite connecting surface, wherein whole locating means, for locating wholly said first and second connector housings when said connecting surfaces of said first and second connector housings which face each other are moved to a connecting position where they come close to and are connected to each other, are provided to said connecting surface on upper surface of said first connector housing and to said connecting surface on the lower surface of said second connector housing;

wherein a pair of tab portion locating means, for locating said both connector housings in a tab parallel arranging direction where the tab portions of said first terminals are arranged in parallel and in a direction which intersects perpendicularly to the tab parallel arranging direction, are provided to said connecting surface on the upper surface of said first connector housing and to said connecting surface on the lower surface of said second connector housing;

wherein said tab portion locating means are provided to positions in the vicinity of both outer sides of said tab portions of said plural terminals arranged in parallel;

wherein another whole locating-means is provided to said connecting surface on the upper surface of said second connector housing for locating wholly the second connector housing and a third connector housing;

wherein still another whole locating means is provided to said connecting surface on the lower surface of said first connector housing for locating wholly the first connector housing and a fourth connector housing;

wherein another pair of tab portion locating means are provided to said connecting surface on the upper surface of said second connector housing for locating the second connector housing and the third connector housing;

wherein still another pair of tab portion locating means are provided to said connecting surface on the lower surface of said first connector housing for locating the first connector housing and the fourth connector housing, thereby enabling to eternally connect a plurality of connector housings at the upper surface side connecting surface of said second connector housing and at the lower surface side of said connecting surface of said first connector housing in the multi-stage form.

2. A press-contact joint connector according to claim 1, wherein said pair of tab portion locating means are composed of a pair of protruded portions which are provided to one of the connecting surfaces of said first and second connector housings and a pair of groove portions which are provided to the other of the connecting surfaces;

wherein said pair of protruded portions are engaged with said pair of groove portions;

wherein said pair of protruded portions and said pair of groove portions become wider towards a direction where they come close to or are separated from each other in the tab parallel arranging direction; and wherein a distance between said pair of protruded portions and a distance between said pair of groove portions are set so as to be slightly different.

3. A press-contact joint connector according to claim 2, wherein a plurality of mis-connection preventing protrusions which can be cut are provided to one of the connecting surfaces of said first and second connector housings which face each other;

wherein a plurality of hole portions, into which said mis-connection preventing protrusions are inserted respectively, are provided to the other of the connecting surfaces of said first and second connector housings which face each other;

wherein said plurality of hole portions are provided to positions correspondingly to said plurality of mis-connection preventing protrusions; and wherein walls which can be cut are formed respectively to said plurality of hole portions.

* * * * *